US012780499B2

(12) United States Patent
Liu et al.

(10) Patent No.: US 12,780,499 B2
(45) Date of Patent: Nov. 3, 2026

(54) MULTIFUNCTIONAL CUP HANDLE

(71) Applicant: Hangzhou Haers Industrial Co., Ltd., Hangzhou (CN)

(72) Inventors: Runjun Liu, Hangzhou (CN); Bo Ouyang, Hangzhou (CN); Shouren Hu, Hangzhou (CN); Zhaozhan Xu, Hangzhou (CN)

(73) Assignee: Hangzhou Haers Industrial Co., Ltd., Hangzhou (CN)

( * ) Notice: Subject to any disclaimer, the term of this patent is extended or adjusted under 35 U.S.C. 154(b) by 0 days.

(21) Appl. No.: 19/309,667

(22) Filed: Aug. 26, 2025

(65) Prior Publication Data

US 2025/0376298 A1 Dec. 11, 2025

Related U.S. Application Data

(62) Division of application No. 18/594,002, filed on Mar. 4, 2024, now Pat. No. 12,509,281.

(30) Foreign Application Priority Data

Jun. 7, 2023 (CN) ..... 202321437914.5

(51) Int. Cl.
*B65D 25/28* (2006.01)

(52) U.S. Cl.
CPC ..... *B65D 25/2811* (2013.01); *B65D 25/282* (2013.01); *B65D 2525/288* (2013.01)

(58) Field of Classification Search
CPC ..... B65D 25/2844; B65D 25/2852; B65D 25/2835; B65D 2525/288; B65D 25/2811; B65D 25/282
USPC ..... 220/764, 763, 762
See application file for complete search history.

(56) References Cited

U.S. PATENT DOCUMENTS 5,823,385 A * 10/1998 Cautereels ..... B65D 25/282 220/762
2026/0021939 A1* 1/2026 Chen ..... B65D 25/282

* cited by examiner

*Primary Examiner* — Stephen J Castellano
(74) *Attorney, Agent, or Firm* — Bayramoglu Law Offices LLC

(57) ABSTRACT

A multifunctional cup handle includes a cup body. An upper portion of an outer side of a wall of the cup body is provided with a cup protrusion. A fixed shaft is provided on the cup protrusion. An upper end of a bending handle is provided with a handle shaft hole. The handle is sleeved on the fixed shaft. A locking device is provided on the fixed shaft. When a lower end of the bending handle is rotated to a highest position, the locking device locks the handle shaft hole, such that the lower end located directly above the cup body forms a lifting yoke of the cup body. When the lower end of the bending handle is rotated to a lowest position, the locking device locks the handle shaft hole, such that the bending handle at a side of the cup body forms a grip of the cup body.

2 Claims, 20 Drawing Sheets

MULTIFUNCTIONAL CUP HANDLE

CROSS REFERENCE TO THE RELATED APPLICATIONS

This application is a divisional application of U.S. patent application Ser. No. 18/594,002, filed on Mar. 4, 2024, which is based upon and claims priority to Chinese Patent Application No. 202321437914.5, filed on Jun. 7, 2023, the entire contents of which are incorporated herein by reference.

TECHNICAL FIELD

The present disclosure relates to a cup, and in particular to a multifunctional cup handle.

BACKGROUND

Cups are frequently-used water containers. Some cups are provided with a lifting yoke, so as to be carried conveniently outdoors. Some cups are provided with a grip, so as to drink water conveniently. For the sake of convenient carrying and water drinking, there emerges a cup with a lifting yoke and a grip. However, concerning a cup with a lifting yoke and a grip, both weight and size are greatly increased.

SUMMARY

An objective of the present disclosure is to provide a multifunctional cup handle. The multifunctional cup handle can be converted into a cup lifting yoke or a cup grip. The present disclosure creatively realizes mutual conversion between the cup grip and the cup lifting yoke, and makes a cup used more conveniently.

To achieve the foregoing objective, the present disclosure adopts the following technical solutions:

A multifunctional cup handle includes a cup body, where an upper portion of an outer side of a wall of the cup body is provided with a cup protrusion; a fixed shaft is provided on the cup protrusion; an axis of the fixed shaft is formed into an included angle $\alpha$ of 40-80° with a vertical line; an upper end of a bending handle is provided with a handle shaft hole; the handle shaft hole is rotatably sleeved on the fixed shaft; a locking device for stopping the handle shaft hole from rotating is provided on the fixed shaft; when a lower end of the bending handle is rotated around the fixed shaft to a highest position, the locking device locks the handle shaft hole, such that the lower end located directly above the cup body forms a lifting yoke of the cup body; and when the lower end of the bending handle is rotated around the fixed shaft to a lowest position, the locking device locks the handle shaft hole, such that the bending handle located at a side of the cup body forms a grip of the cup body.

The locking device includes: a mounting hole formed in a top or a bottom of the fixed shaft, a spring and a locking bead provided in the mounting hole; and stopping grooves respectively formed in a top and a bottom of the handle shaft hole and matching with the locking bead.

The fixed shaft includes a narrow segment and a wide segment; the handle shaft hole is sleeved on the wide segment; a locating plane is at least provided on the narrow segment; a protrusion shaft hole matching with the narrow segment is formed in the cup protrusion; a straight-surface protrusion matching with the locating plane is provided in the protrusion shaft hole to stop the fixed shaft from rotating; and a fixing screw for fixing the narrow segment is further provided on the cup protrusion.

The fixed shaft includes a narrow segment and a wide segment; the locking device includes: a fixed shaft guiding groove formed in a top of the fixed shaft, a button slidably provided in a fixed shaft inner hole, a top stopping groove formed in a top of the handle shaft hole, and a bottom stopping groove formed in a bottom of the handle shaft hole; the button is composed of a cylindrical portion and a button panel portion; a stopping convex rib is provided on a top of the cylindrical portion; button protrusions are respectively provided at a front side and a rear side of the cylindrical portion; sliding chutes matching with the corresponding button protrusions are respectively formed in a front side and a rear side of the fixed shaft inner hole; a button spring is sleeved on the cylindrical portion between the wide segment and the button panel portion; when the top stopping groove is located at a highest position, the top stopping groove is engaged with the fixed shaft guiding groove to form a moving passage of the stopping convex rib, the button protrusions are stopped at right ends of the sliding chutes under an elastic force of the button spring, a left part of the stopping convex rib is located in the fixed shaft guiding groove, a right part of the stopping convex rib is located in the top stopping groove, and the stopping convex rib stops the handle shaft hole from rotating; when the button is pressed to move leftward for a preset distance, the stopping convex rib completely moves out from the top stopping groove to enter the fixed shaft guiding groove, and the stopping convex rib does not stop the handle shaft hole from rotating; when the bottom stopping groove is located at the highest position, the bottom stopping groove is engaged with the fixed shaft guiding groove to form a moving passage of the stopping convex rib, the button protrusions are stopped at the right ends of the sliding chutes under the elastic force of the button spring, the left part of the stopping convex rib is located in the fixed shaft guiding groove, the right part of the stopping convex rib is located in the bottom stopping groove, and the stopping convex rib stops the handle shaft hole from rotating; and when the button is pressed to move leftward for the preset distance, the stopping convex rib completely moves out from the bottom stopping groove to enter the fixed shaft guiding groove, and the stopping convex rib does not stop the handle shaft hole from rotating.

The handle shaft hole is sleeved on the wide segment; a locating plane is at least provided on the narrow segment; a protrusion shaft hole matching with the narrow segment is formed in the cup protrusion; a straight-surface protrusion matching with the locating plane is provided in the protrusion shaft hole to stop the fixed shaft from rotating; and a protrusion guiding groove matching with the stopping convex rib is formed in a top of the cup protrusion.

A bottom of the narrow segment is fixed on the cup protrusion through a fixing screw.

A right end of the wide segment is provided with an annular groove for supporting the button spring.

A left side of the handle shaft hole is provided with a shaft hole with a larger diameter; a handle protrusion is provided in the shaft hole; and a fixed shaft turning groove is provided between an outer periphery of a lower half part of the wide segment and an inner wall of the shaft hole.

The present disclosure has the following beneficial effects over the prior art: According to the above technical solutions, an upper portion of an outer side of a wall of a cup body is provided with a cup protrusion. A fixed shaft is provided on the cup protrusion. An axis of the fixed shaft is formed into an included angle a of 40-80° with a vertical line. An upper end of a bending handle is provided with a handle shaft hole. The handle shaft hole is rotatably sleeved on the fixed shaft. A locking device for stopping the handle shaft hole from rotating is provided on the fixed shaft. When a lower end of the bending handle is rotated around the fixed shaft to a highest position, the locking device locks the handle shaft hole, such that the lower end located directly above the cup forms a lifting yoke of the cup body. When the lower end of the bending handle is rotated around the fixed shaft to a lowest position, the locking device locks the handle shaft hole, such that the bending handle located at a side of the cup body forms a grip of the cup body. The present disclosure creatively realizes mutual conversion between a cup grip and a cup lifting yoke, and can quickly convert holding and carrying methods of the cup as required by a user. Compared with a cup with a lifting yoke and a grip, the present disclosure not only reduces a weight and a size of the cup, but also makes the cup used more flexibly and conveniently.

The present disclosure further has the following beneficial effects: The locking device in the first solution is advantageous for less components, a simple structure, and a low cost. The locking device in the second solution is firm and reliable in locking

DETAILED DESCRIPTION OF THE EMBODIMENTS

Figure 1:
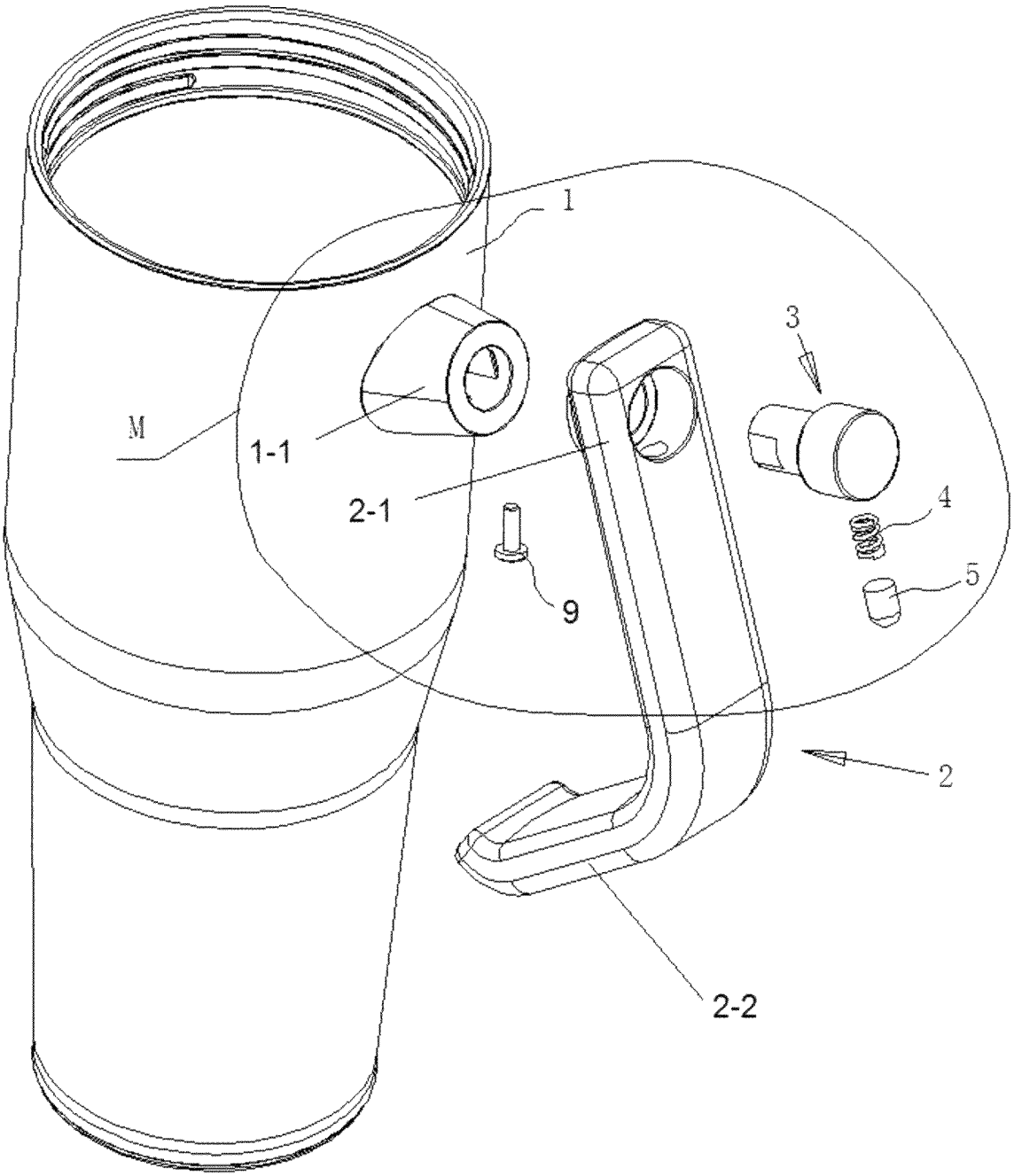
FIG. 1 is a schematic structural view according to a first solution of the present disclosure.
Figure 2:
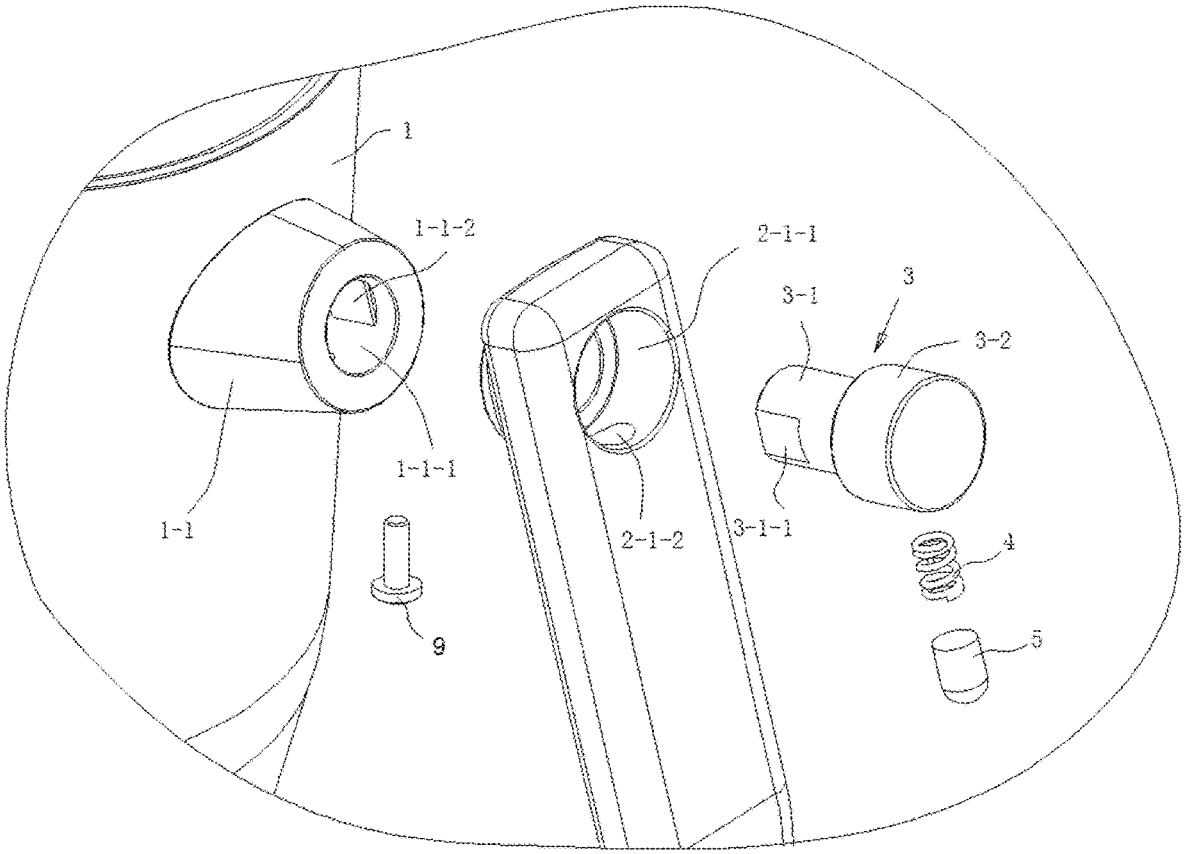
FIG. 2 is an enlarged view of M in FIG. 1.
Figure 3:
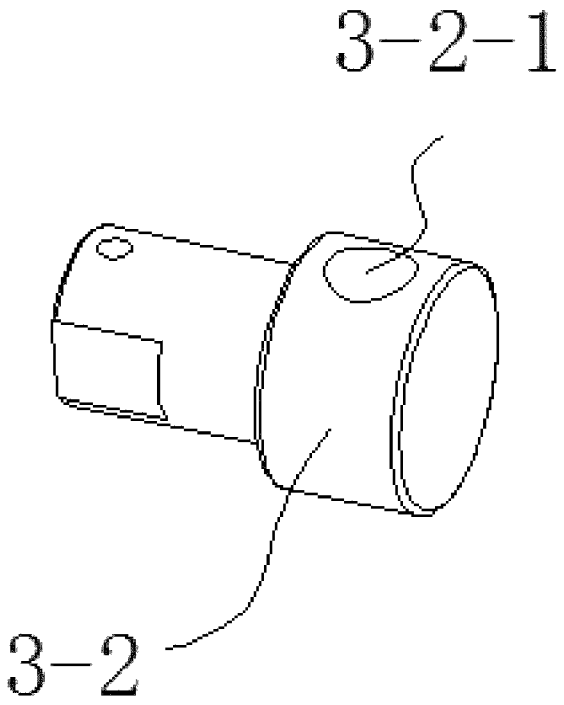
FIG. 3 is a schematic structural view illustrating that a fixed shaft is rotated around its axis for 180° in FIG. 2.
Figure 4:
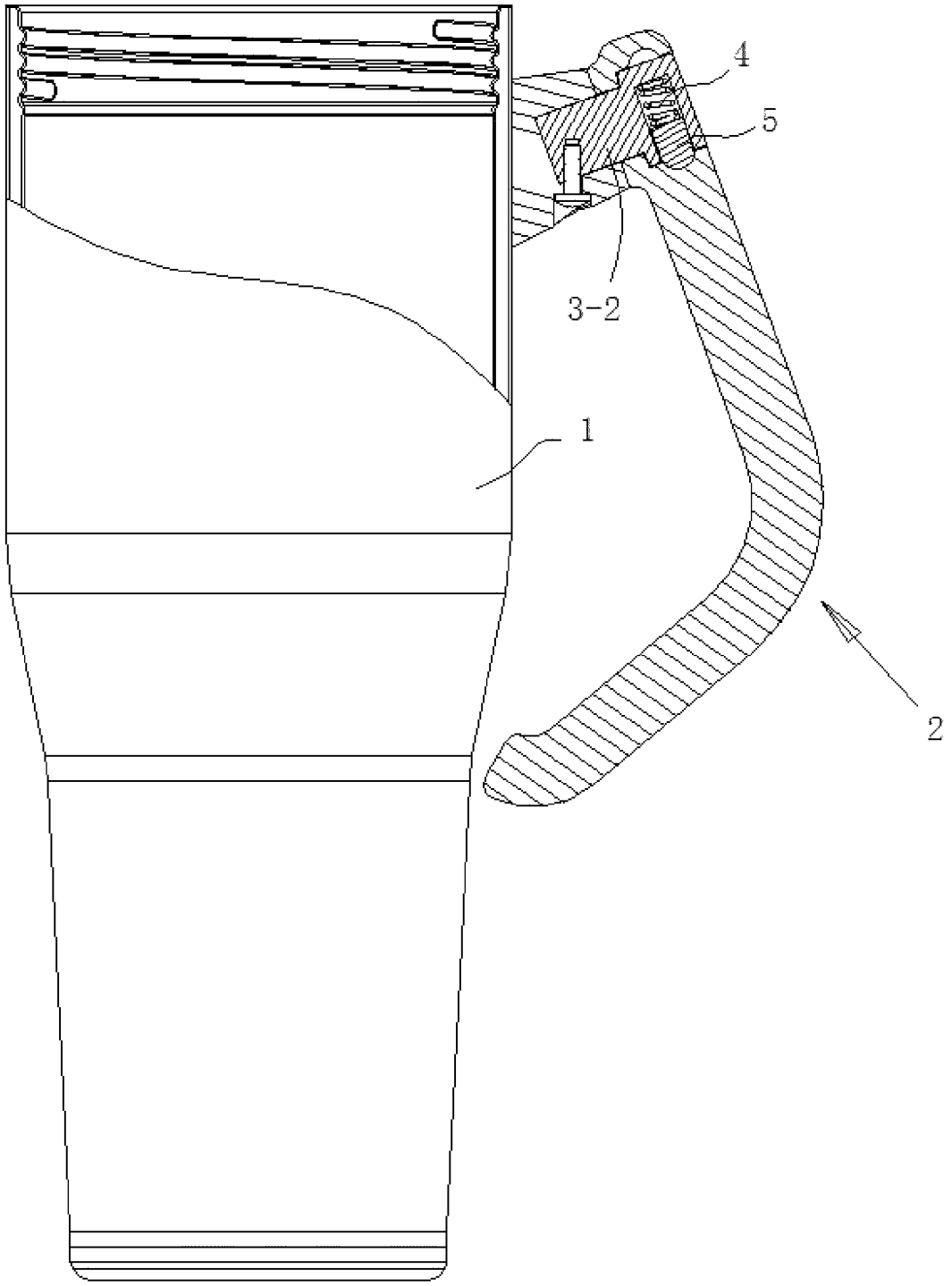
FIG. 4 is a partially sectional view of an assembly structure in FIG. 1.
Figure 5:
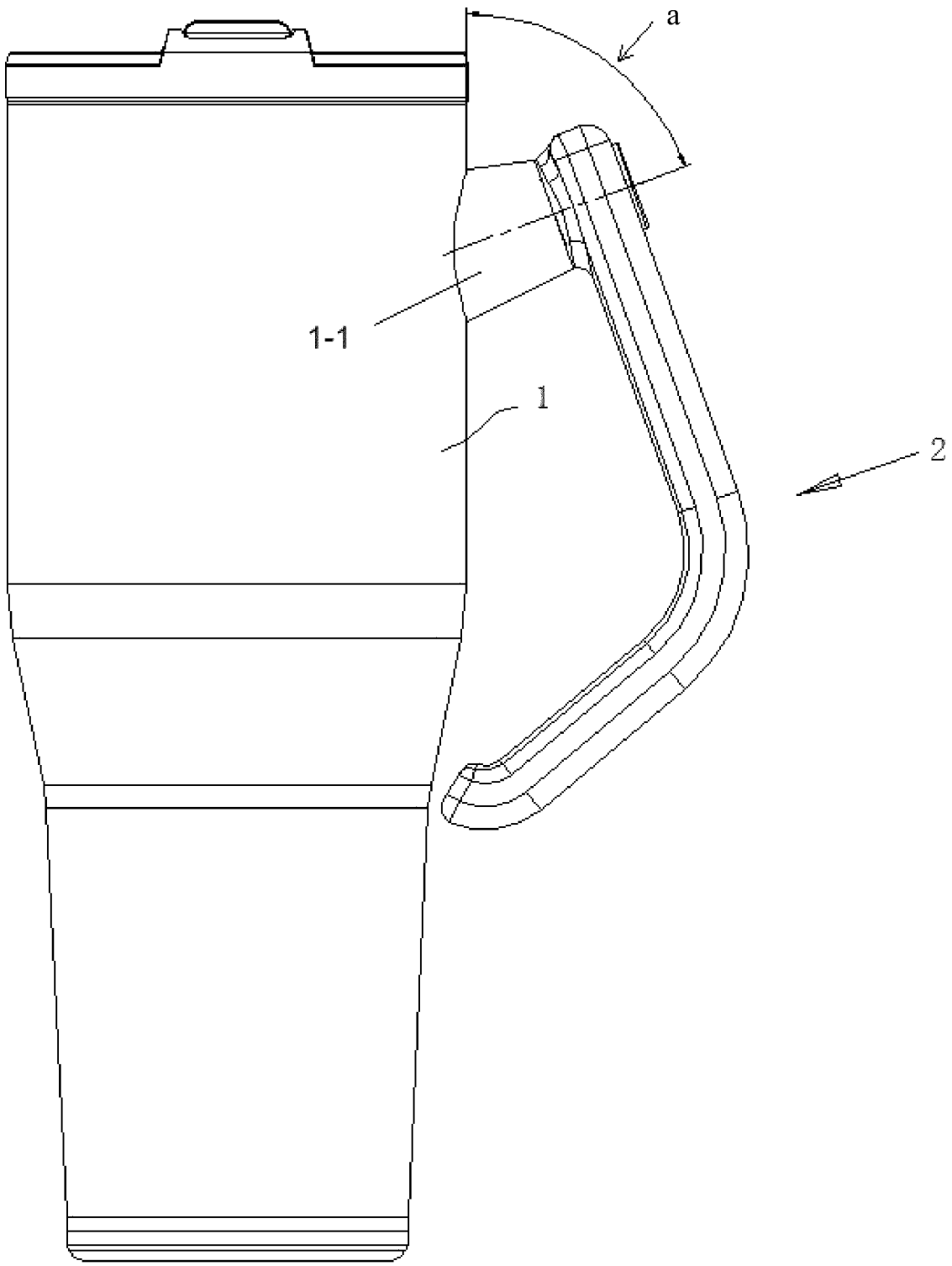
FIG. 5 is a schematic structural view when a bending handle in FIG. 4 is rotated to a lowest position.
Figure 6:
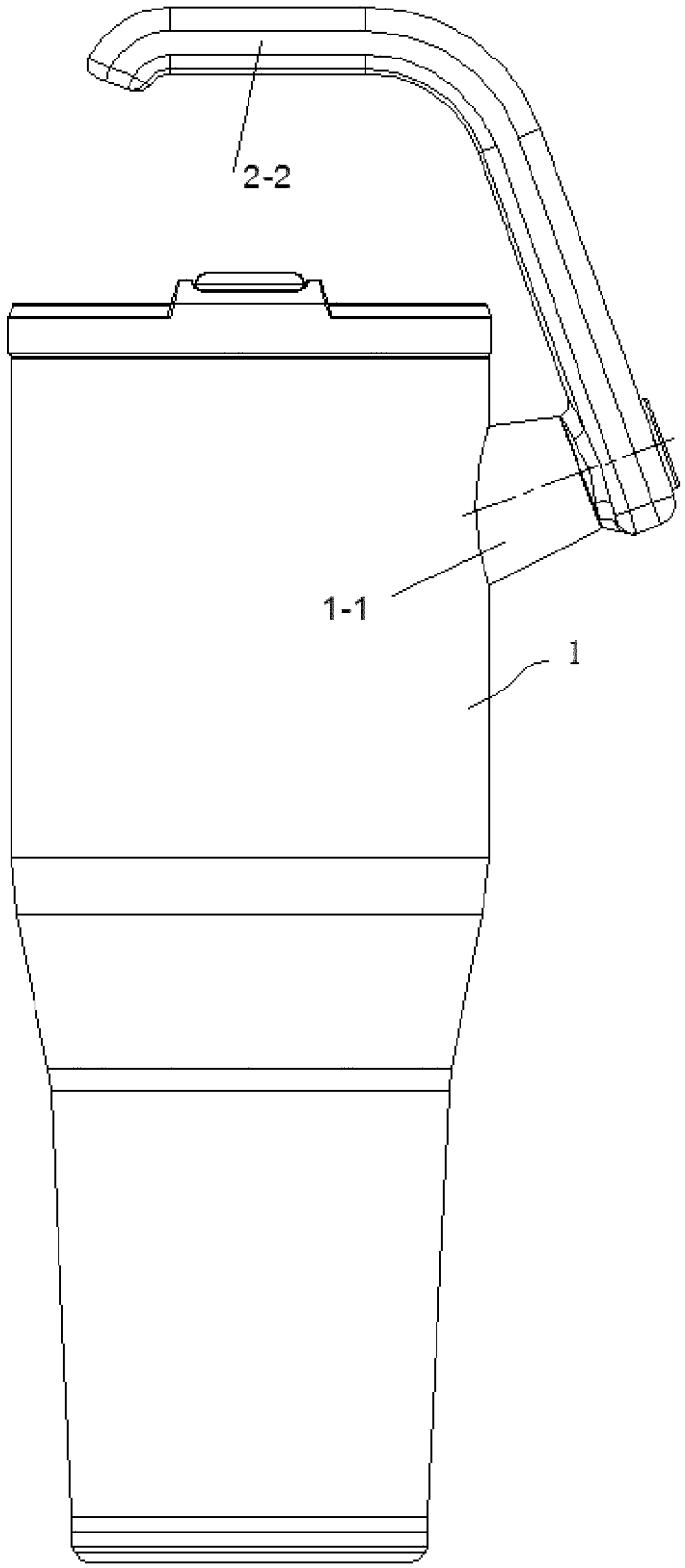
FIG. 6 is a schematic structural view when a bending handle in FIG. 4 is rotated to a highest position.
Figure 7:
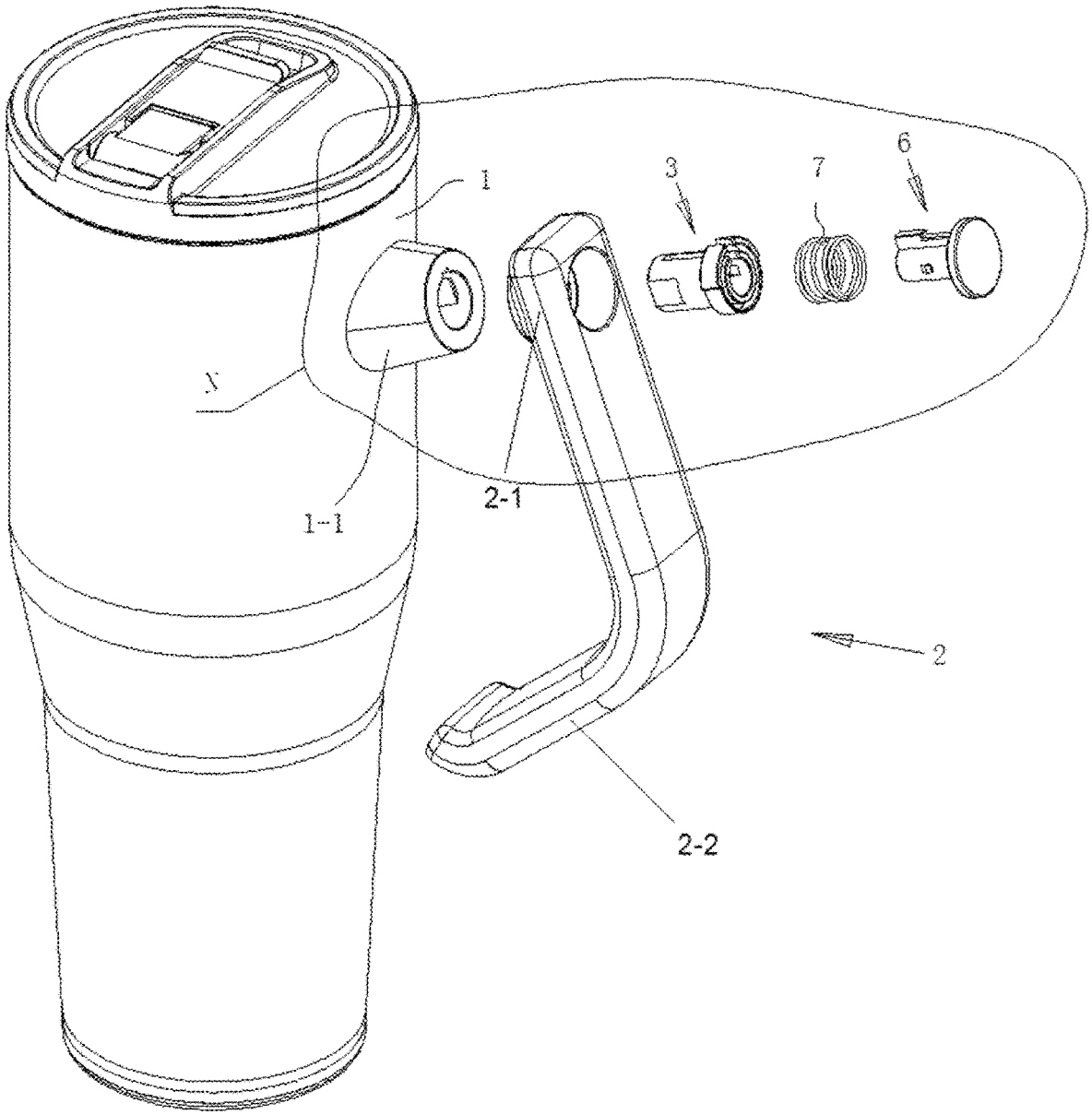
FIG. 7 is a schematic structural view according to a second solution of the present disclosure.
Figure 8:
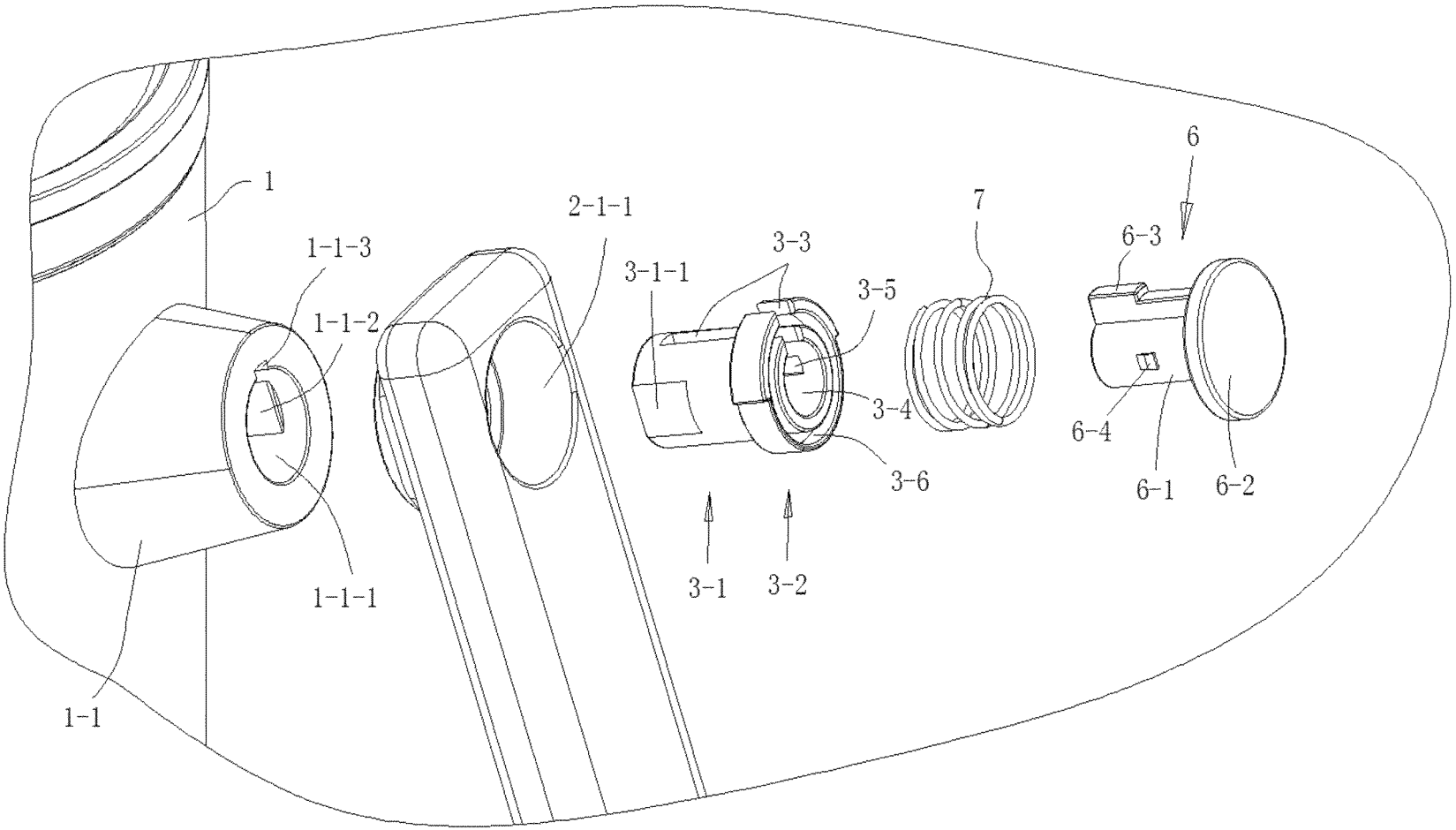
FIG. 8 is an enlarged view of N in FIG. 7.
Figure 9:
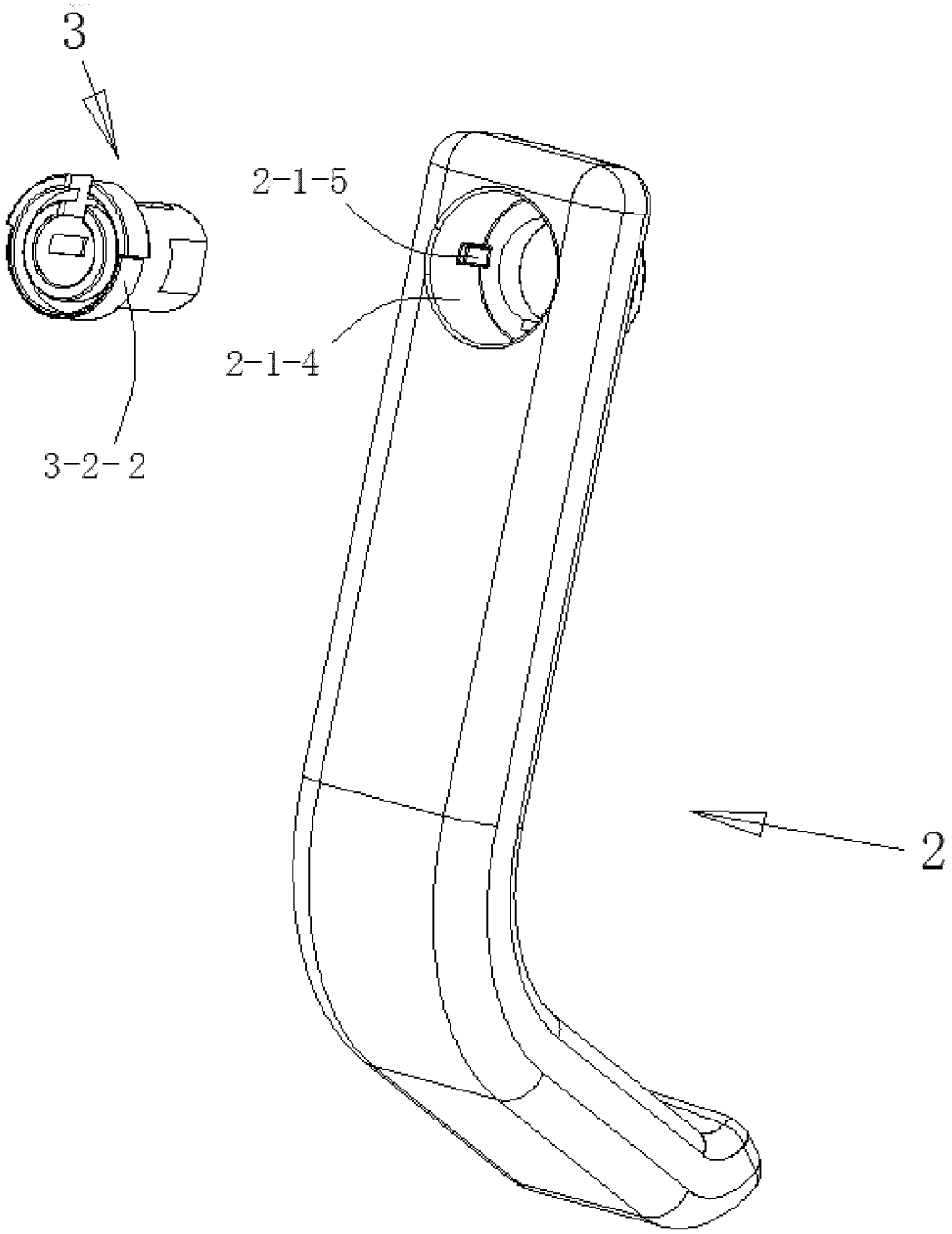
FIG. 9 is an exploded schematic structural view of a bending handle and a fixed shaft in FIG. 7.
Figure 10:
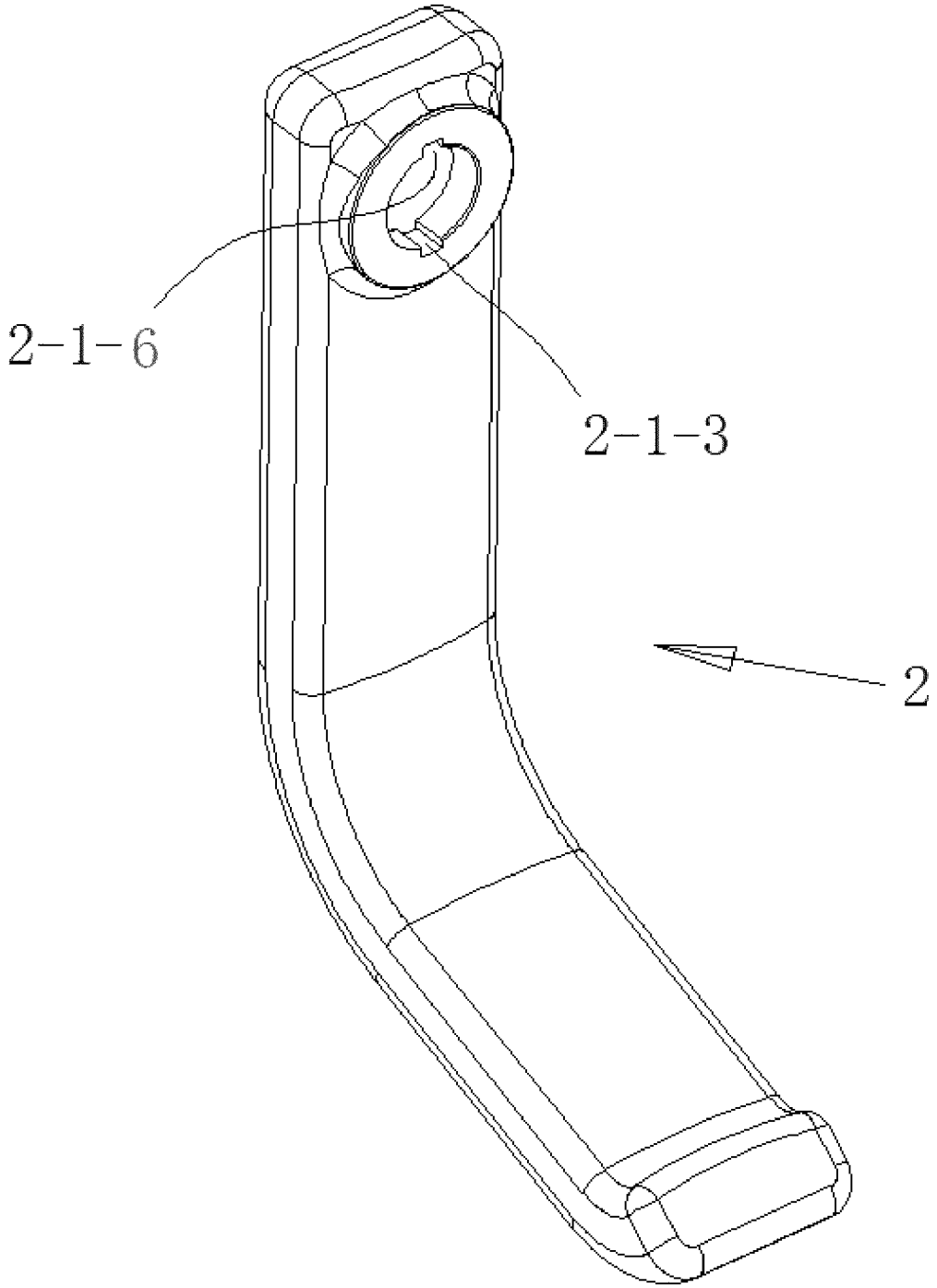
FIG. 10 is a schematic structural view of an inner side of a bending handle in FIG. 7.
Figure 11:
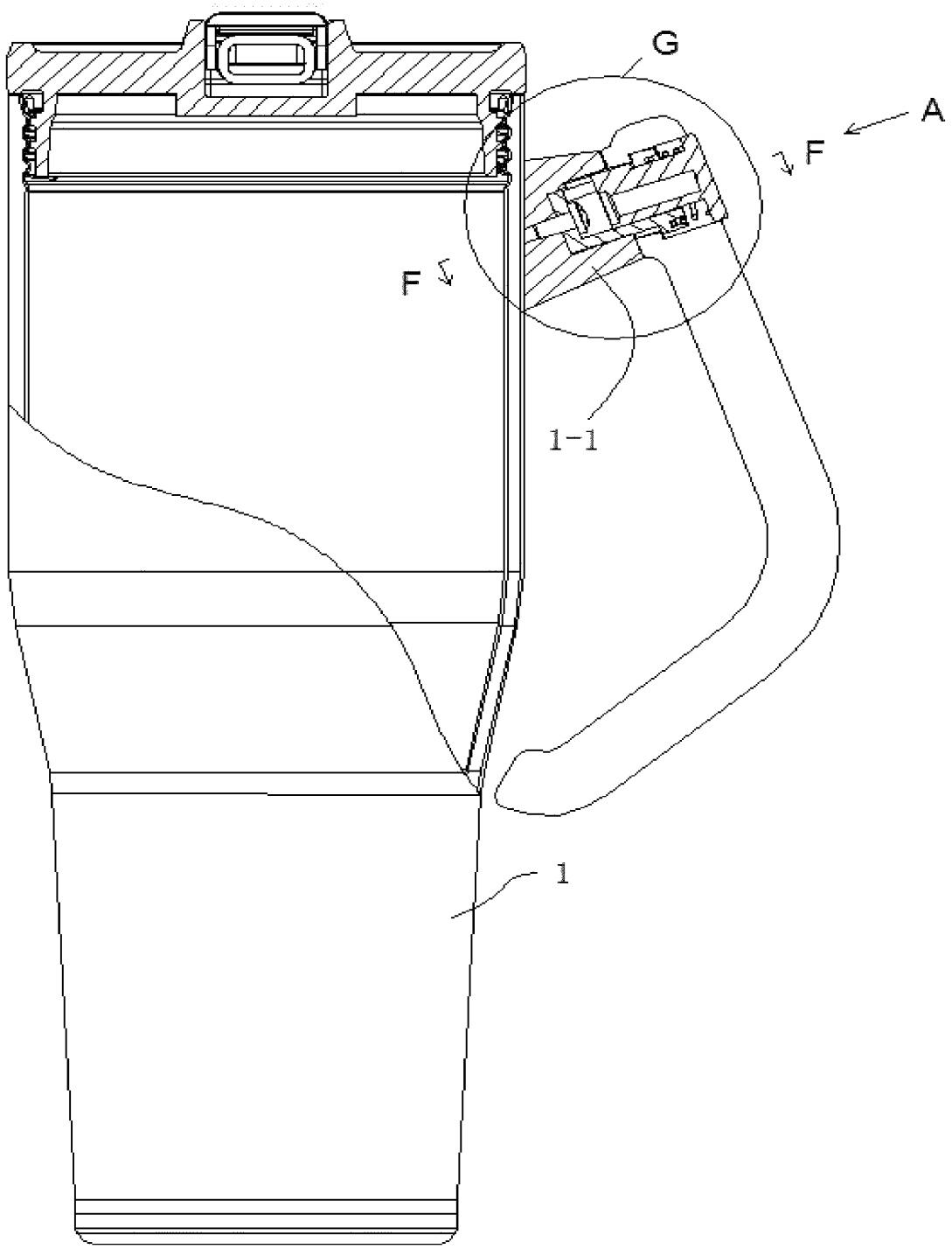
FIG. 11 is a partially sectional view of an assembly structure in FIG. 7.
Figure 12:
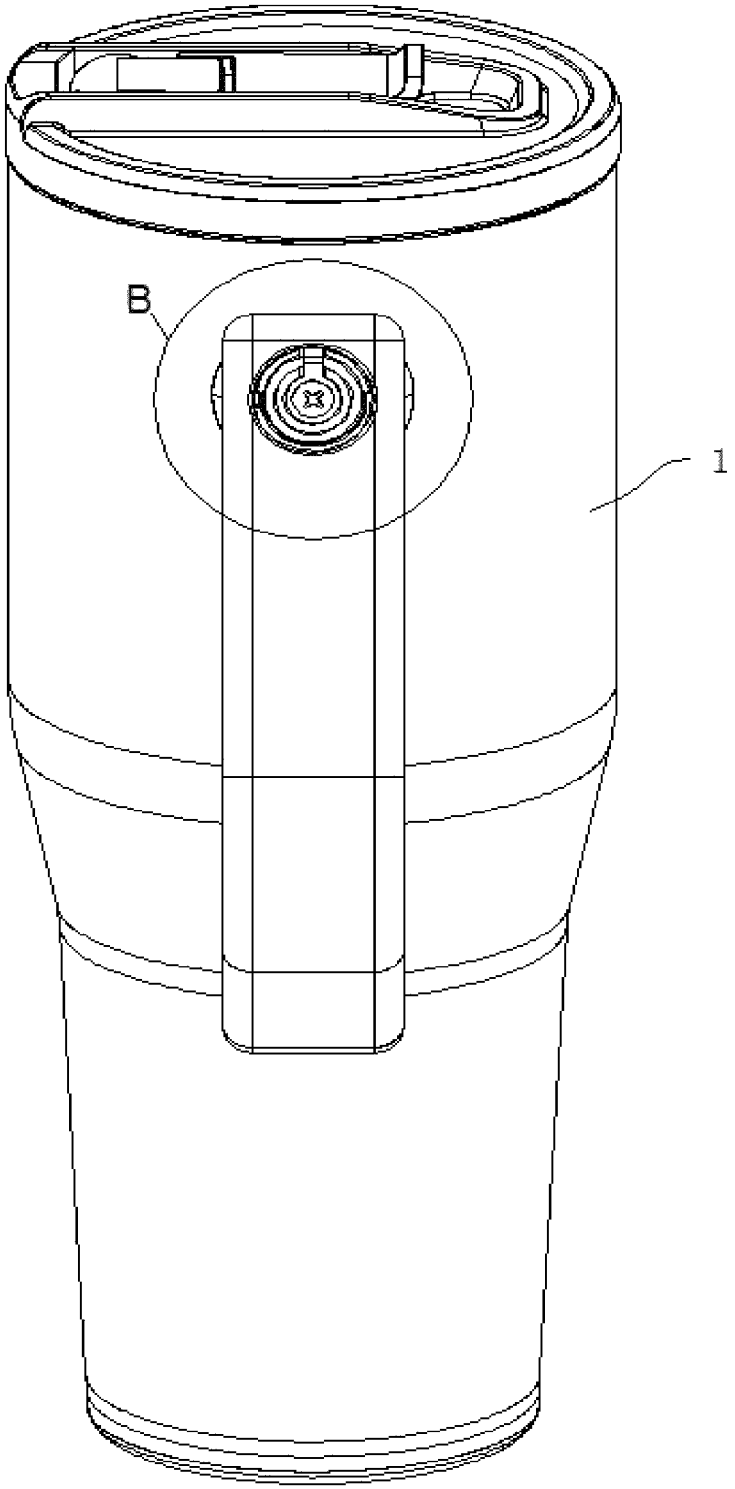
FIG. 12 is a schematic view of rotation in a direction A in FIG. 11.
Figure 13:
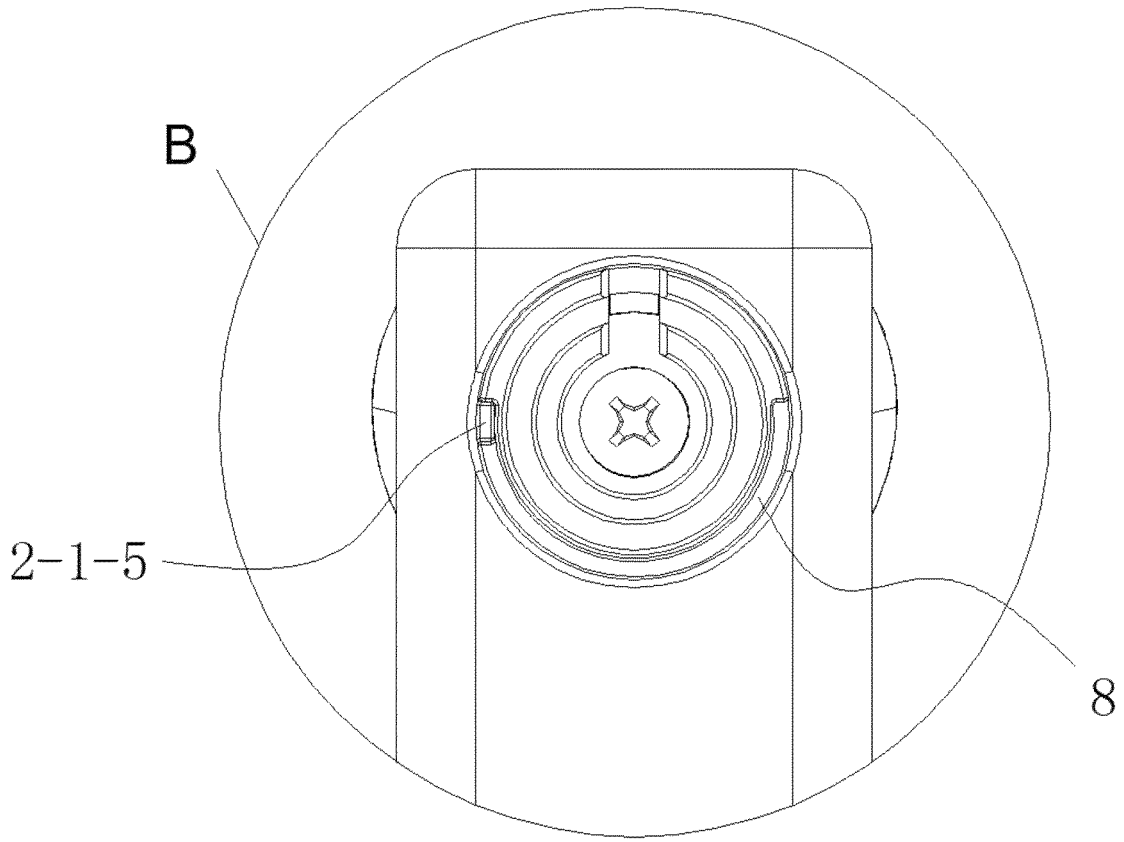
FIG. 13 is an enlarged view of B in FIG. 12.
Figure 14:
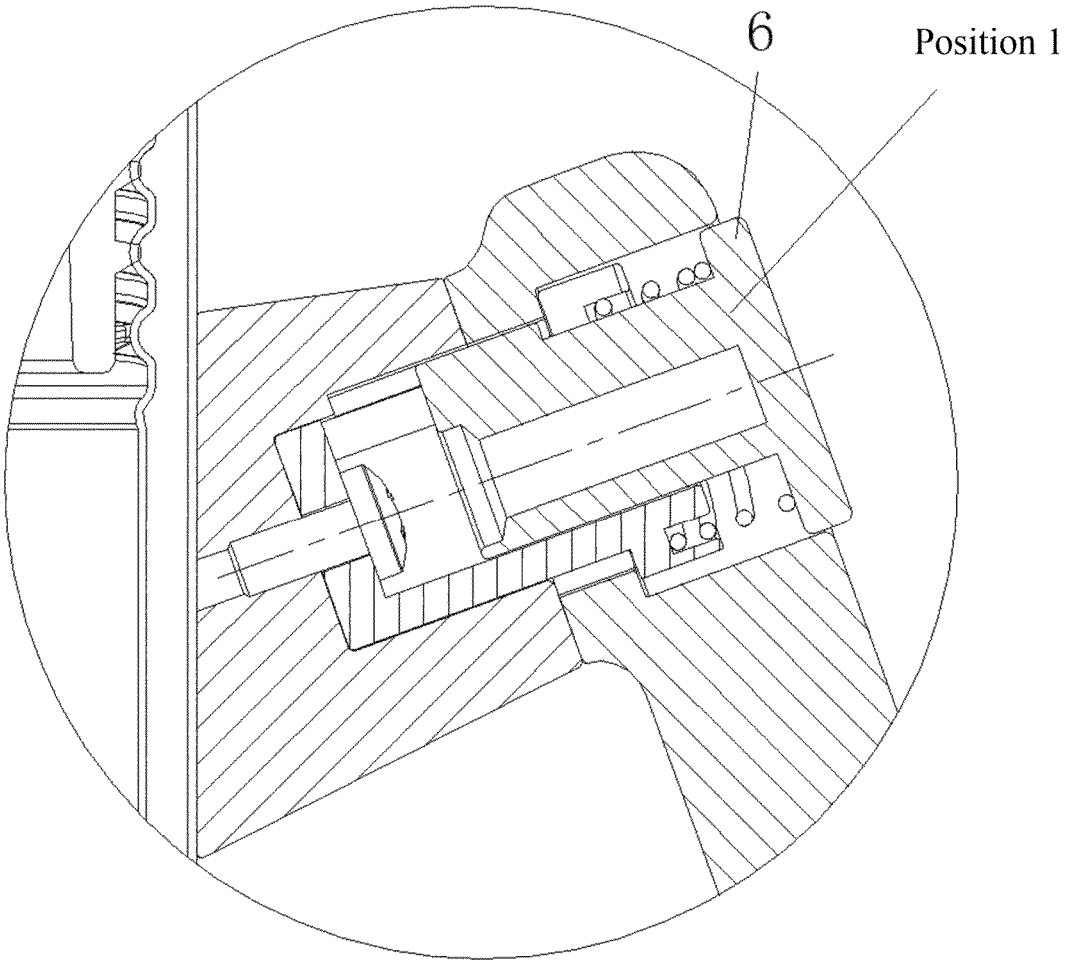
FIG. 14 is an enlarged view of G in FIG. 11.
Figure 15:
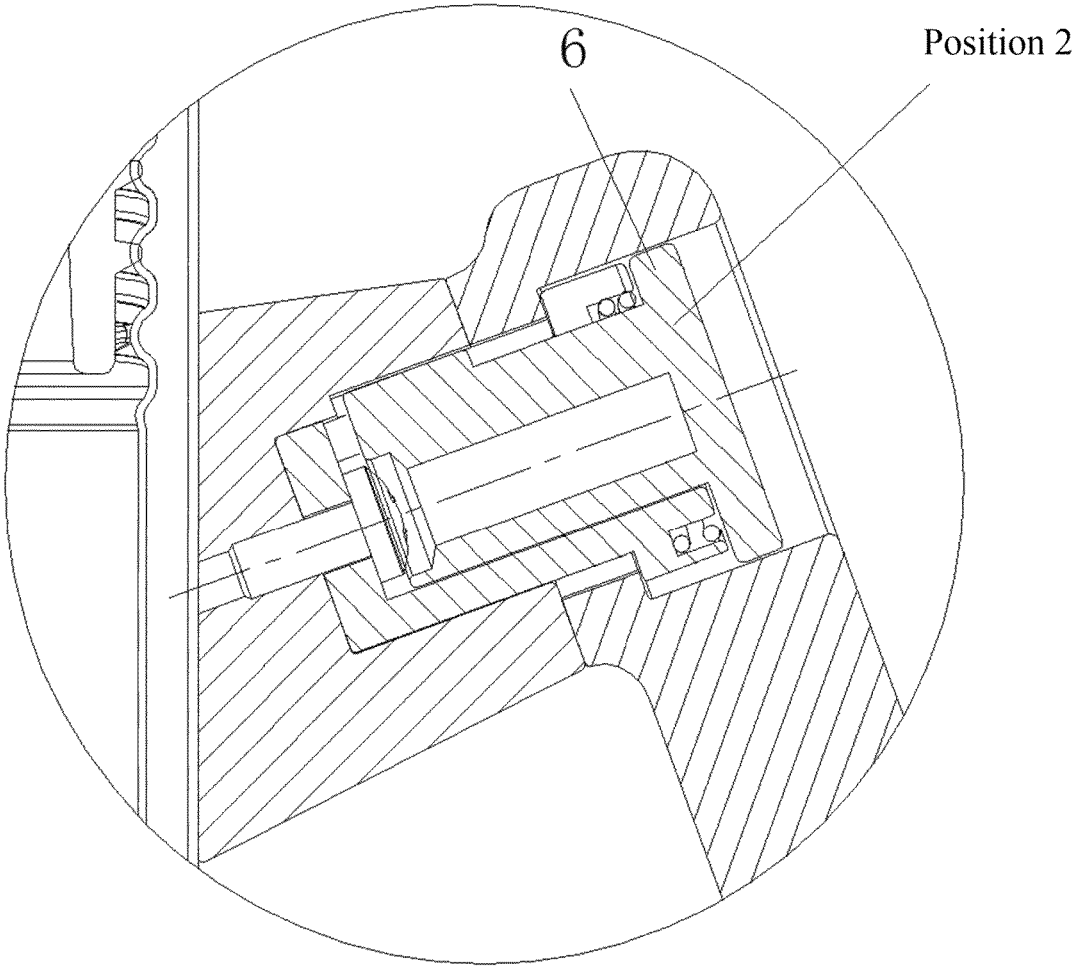
FIG. 15 is a schematic structural view when a button is pressed in FIG. 14.
Figure 16:
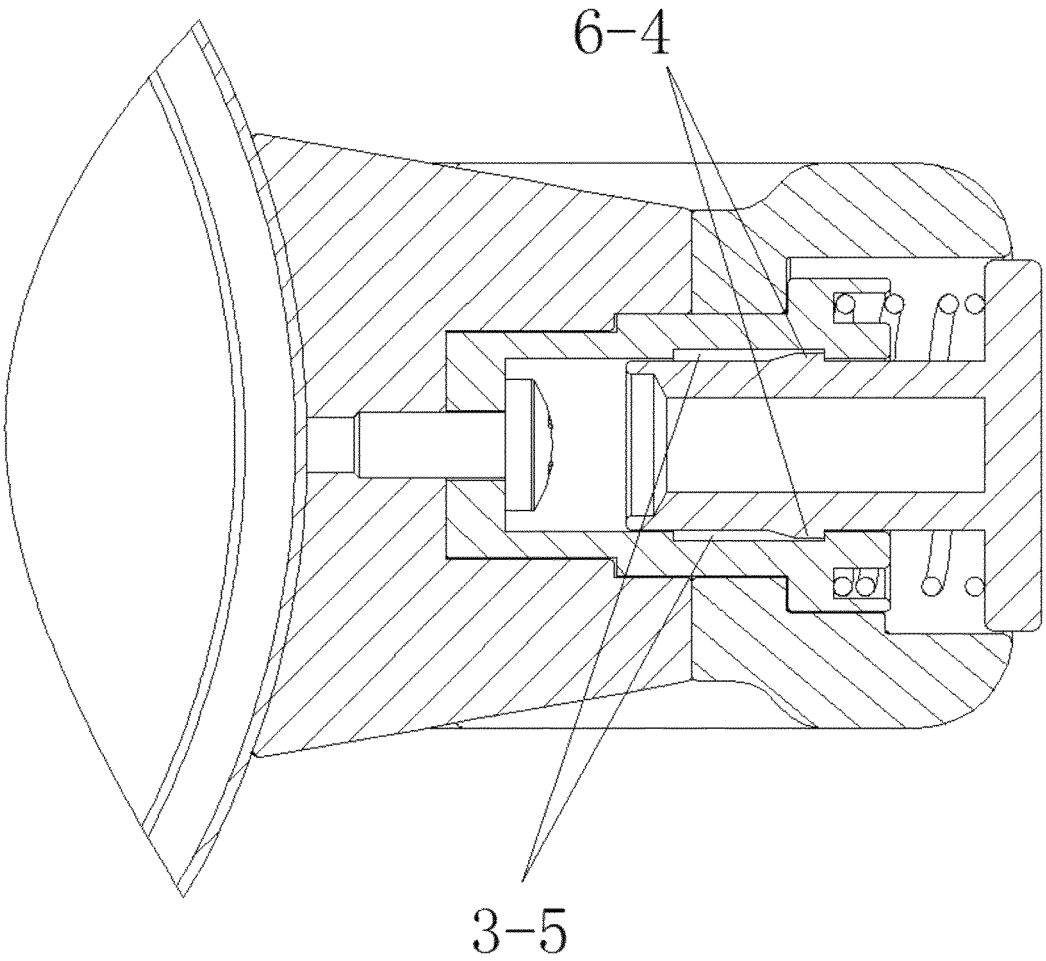
FIG. 16 is a sectional view of rotation in a direction F-F in FIG. 11.
Figure 17:
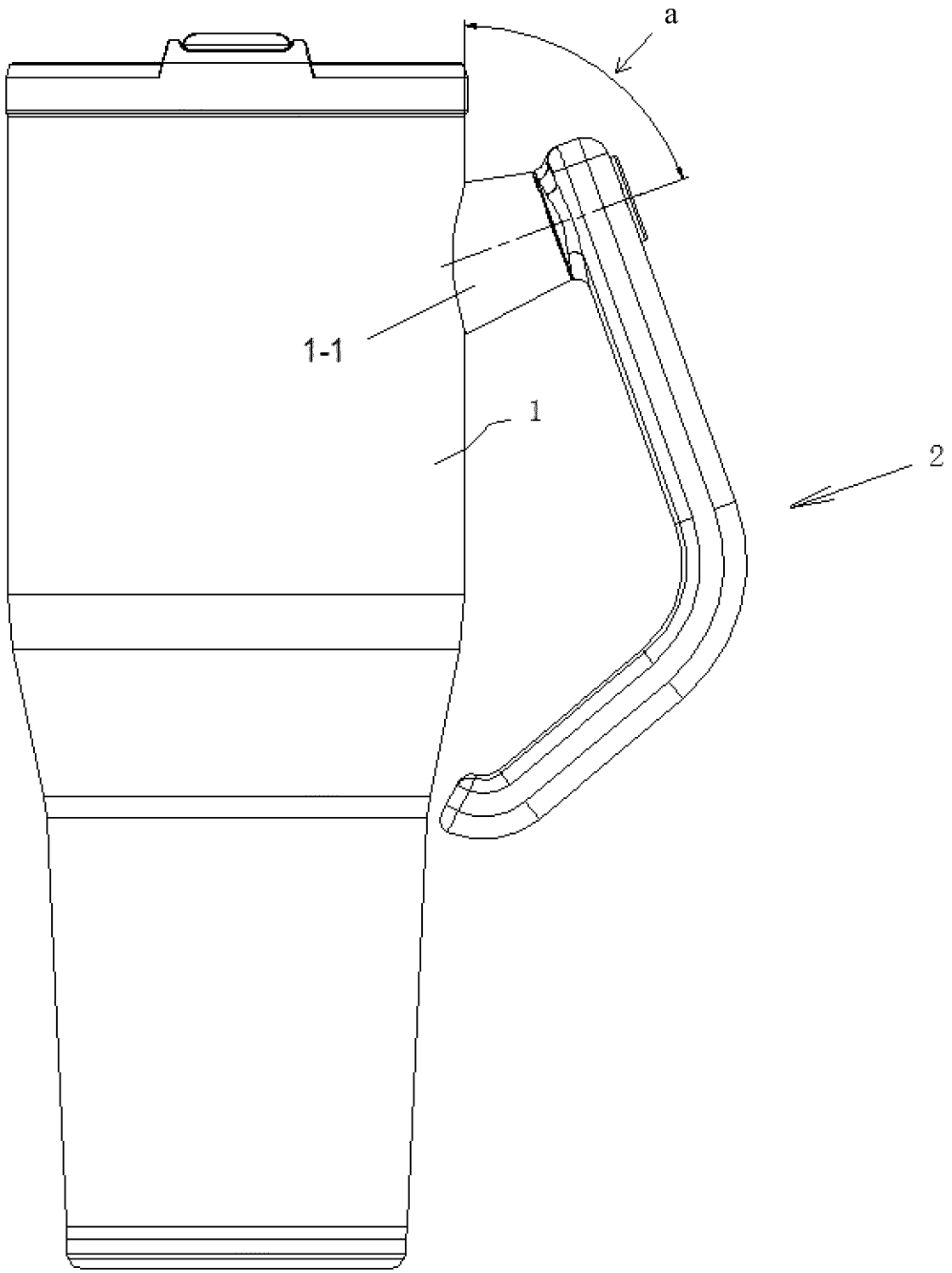
FIG. 17 is a schematic structural view when a bending handle in FIG. 11 is rotated to a lowest position.
Figure 18:
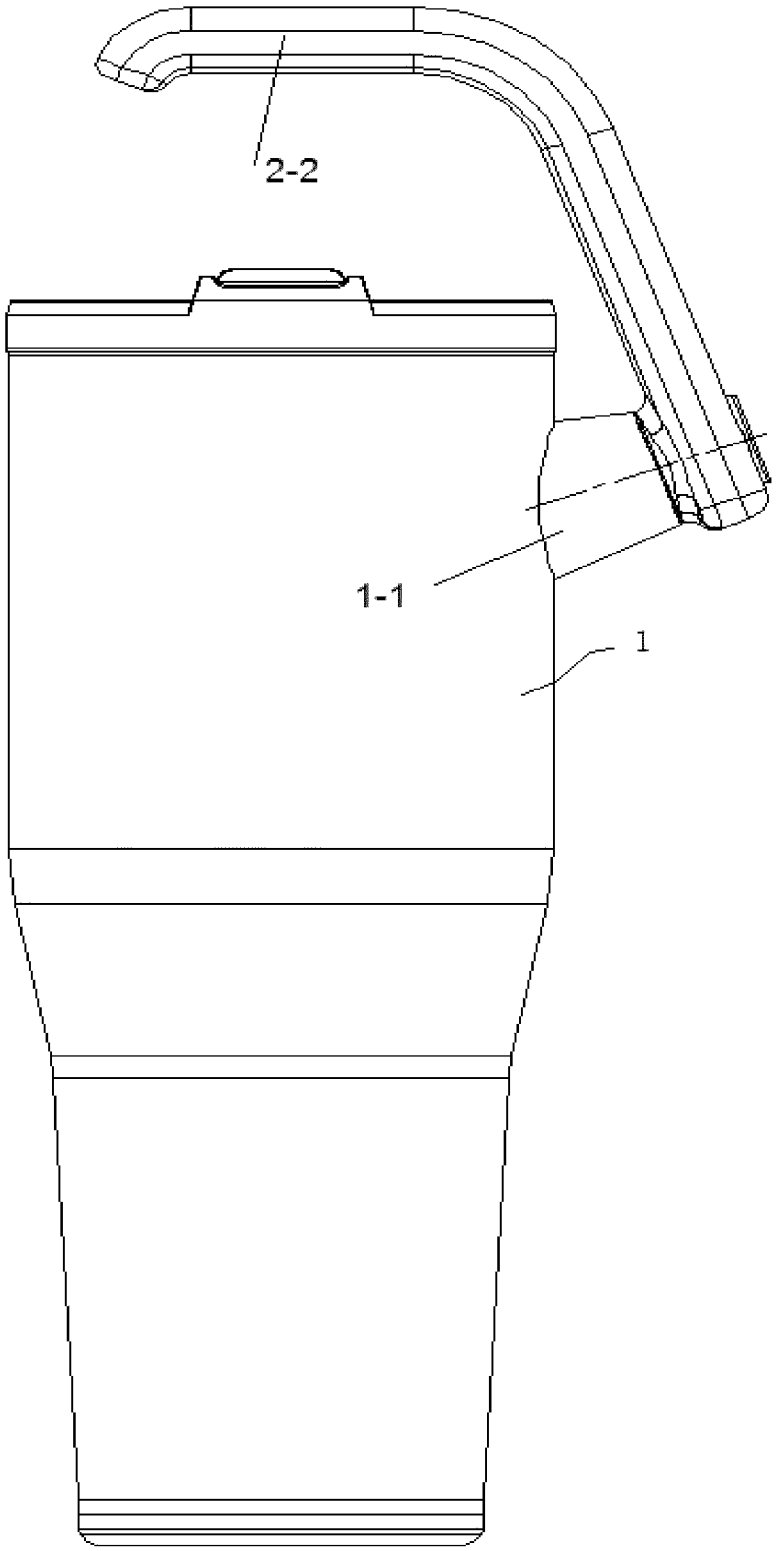
FIG. 18 is a schematic structural view when a bending handle in FIG. 11 is rotated to a highest position.

To make the technical solutions of the present disclosure clearer, the present disclosure is described in detail below with reference to FIG. 1 to FIG. 20. It should be understood that the specific implementations described herein are merely intended to explain the present disclosure, rather than to limit the protection scope of the present disclosure.

The present disclosure provides a multifunctional cup handle, including cup body 1. An upper portion of an outer side of a wall of the cup body 1 is provided with cup protrusion 1-1. Fixed shaft 3 is provided on the cup protrusion 1-1. An axis of the fixed shaft 3 is formed into an included angle a of 40-80° (preferably) 70-75° with a vertical line. Upper end 2-1 of bending handle 2 is provided with handle shaft hole 2-1-1. The handle shaft hole 2-1-1 is rotatably sleeved on the fixed shaft 3. A locking device for stopping the handle shaft hole 2-1-1 from rotating is provided on the fixed shaft 3. When lower end 2-2 of the bending handle is rotated around the fixed shaft 3 to a highest position, the locking device locks the handle shaft hole 2-1-1, such that the lower end 2-2 located directly above the cup body 1 forms a lifting yoke of the cup body 1. When the lower end 2-2 of the bending handle is rotated around the fixed shaft 3 to a lowest position, the locking device locks the handle shaft hole 2-1-1, such that the bending handle 2 located at a side of the cup body 1 forms a grip of the cup body 1.

As a first preferred solution, the locking device includes: mounting hole 3-2-1 formed in a bottom of the fixed shaft 3, spring 4 and locking bead 5 provided in the mounting hole 3-2-1, and stopping grooves 2-1-2 respectively formed in a top and a bottom of the handle shaft hole 2-1-1 and matching with the locking bead 5. The fixed shaft 3 includes narrow segment 3-1 and wide segment 3-2. The handle shaft hole 2-1-1 is sleeved on the wide segment 3-2. Locating plane 3-1-1 is at least provided on the narrow segment 3-1. Protrusion shaft hole 1-1-1 matching with the narrow segment 3-1 is formed in the cup protrusion 1-1. Straight-surface protrusion 1-1-2 matching with the locating plane 3-1-1 is provided in the protrusion shaft hole 1-1-1 to stop the fixed shaft 3 from rotating. Fixing screw 9 for fixing the narrow segment 3-1 is further provided on the cup protrusion 1-1.

As a second preferred solution, the fixed shaft 3 includes narrow segment 3-1 and wide segment 3-2. The locking device includes: fixed shaft guiding groove 3-3 formed in a top of the fixed shaft 3, button 6 slidably provided in fixed shaft inner hole 3-4, top stopping groove 2-1-6 formed in a top of the handle shaft hole 2-1-1, and bottom stopping groove 2-1-3 formed in a bottom of the handle shaft hole 2-1-1. The button 6 is composed of cylindrical portion 6-1 and button panel portion 6-2. Stopping convex rib 6-3 is provided on a top of the cylindrical portion 6-1. Button protrusions 6-4 are respectively provided at a front side and a rear side of the cylindrical portion 6-1. Sliding chutes 3-5 matching with the corresponding button protrusions 6-4 are respectively formed in a front side and a rear side of the fixed shaft inner hole 3-4. Button spring 7 is sleeved on the cylindrical portion 6-1 between the wide segment 3-2 and the button panel portion 6-2. When the top stopping groove 2-1-6 is located at a highest position, the top stopping groove 2-1-6 is engaged with the fixed shaft guiding groove 3-3 to form a moving passage of the stopping convex rib 6-3, the button protrusions 6-4 are stopped at right ends of the sliding chutes 3-5 under an elastic force of the button spring 7, a left part of the stopping convex rib 6-3 is located in the fixed shaft guiding groove 3-3, a right part of the stopping convex rib 6-3 is located in the top stopping groove 2-1-6, and the stopping convex rib 6-3 stops the handle shaft hole 2-1-1 from rotating. When the button 6 is pressed to move leftward for a preset distance, the stopping convex rib 6-3 completely moves out from the top stopping groove 2-1-6 to enter the fixed shaft guiding groove 3-3, and the stopping convex rib 6-3 does not stop the handle shaft hole 2-1-1 from rotating. When the bottom stopping groove 2-1-3 is located at the highest position, the bottom stopping groove 2-1-3 is engaged with the fixed shaft guiding groove 3-3 to form a moving passage of the stopping convex rib 6-3, the button protrusions 6-4 are stopped at the right ends of the sliding chutes 3-5 under the elastic force of the button spring 7, the left part of the stopping convex rib 6-3 is located in the fixed shaft guiding groove 3-3, the right part of the stopping convex rib 6-3 is located in the bottom stopping groove 2-1-3, and the stopping convex rib 6-3 stops the handle shaft hole 2-1-1 from rotating. When the button 6 is pressed to move leftward for the preset distance, the stopping convex rib 6-3 completely moves out from the bottom stopping groove 2-1-3 to enter the fixed shaft guiding groove 3-3, and the stopping convex rib 6-3 does not stop the handle shaft hole 2-1-1 from rotating. The handle shaft hole 2-1-1 is sleeved on the wide segment 3-2. Locating plane 3-1-1 is at least provided on the narrow segment 3-1. Protrusion shaft hole 1-1-1 matching with the narrow segment 3-1 is formed in the cup protrusion 1-1. Straight-surface protrusion 1-1-2 matching with the locating plane 3-1-1 is provided in the protrusion shaft hole 1-1-1 to stop the fixed shaft 3 from rotating. Protrusion guiding groove 1-1-3 matching with the stopping convex rib 6-3 is formed in a top of the cup protrusion 1-1. A bottom of the narrow segment 3-1 is fixed on the cup protrusion 1-1 through a fixing screw. A right end of the wide segment 3-2 is provided with annular groove 3-6 for supporting the button spring 7. A left side of the handle shaft hole 2-1-1 is provided with shaft hole 2-1-4 with a larger diameter. Handle protrusion 2-1-5 is provided in the shaft hole 2-1-4. Fixed shaft turning groove 8 is provided between outer periphery 3-2-2 of the lower half part of the wide segment 3-2 and an inner wall of the shaft hole 2-1-4.

An operation method in the first solution is as follows:

For an operating process for converting a grip (the bending handle 2 is located at the lowest position) into a lifting yoke, refer to FIGS. 1-6. The bending handle 2 is rotated. Under a shear force, the locking bead 5 overcomes an elastic force of the spring 4 and is separated from the stopping groove 2-1-2. When the lower end 2-2 of the bending handle is rotated around the fixed shaft 3 to the highest position, the bending handle is stopped rotating. Under an elastic force of the spring 4, a circular arc-shaped portion at a front end of the locking bead 5 enters the stopping groove 2-1-2 to lock the handle shaft hole 2-1-1. In this case, the lower end 2-2 located directly above the cup body 1 forms the lifting yoke of the cup body 1.

For an operating process for converting the lifting yoke into the grip, refer to FIGS. 1-6. The bending handle 2 is rotated. Under a shear force, the locking bead 5 overcomes an elastic force of the spring 4 and is separated from the stopping groove 2-1-2. When the lower end 2-2 of the bending handle is rotated around the fixed shaft 3 to the lowest position, the bending handle is stopped rotating. Under an elastic force of the spring 4, the circular arc-shaped portion at the front end of the locking bead 5 enters the stopping groove 2-1-1 to lock the handle shaft hole 2-1-2. In this case, the bending handle 2 located at a side of the cup body 1 forms the grip of the cup body 1.

Figure 19:
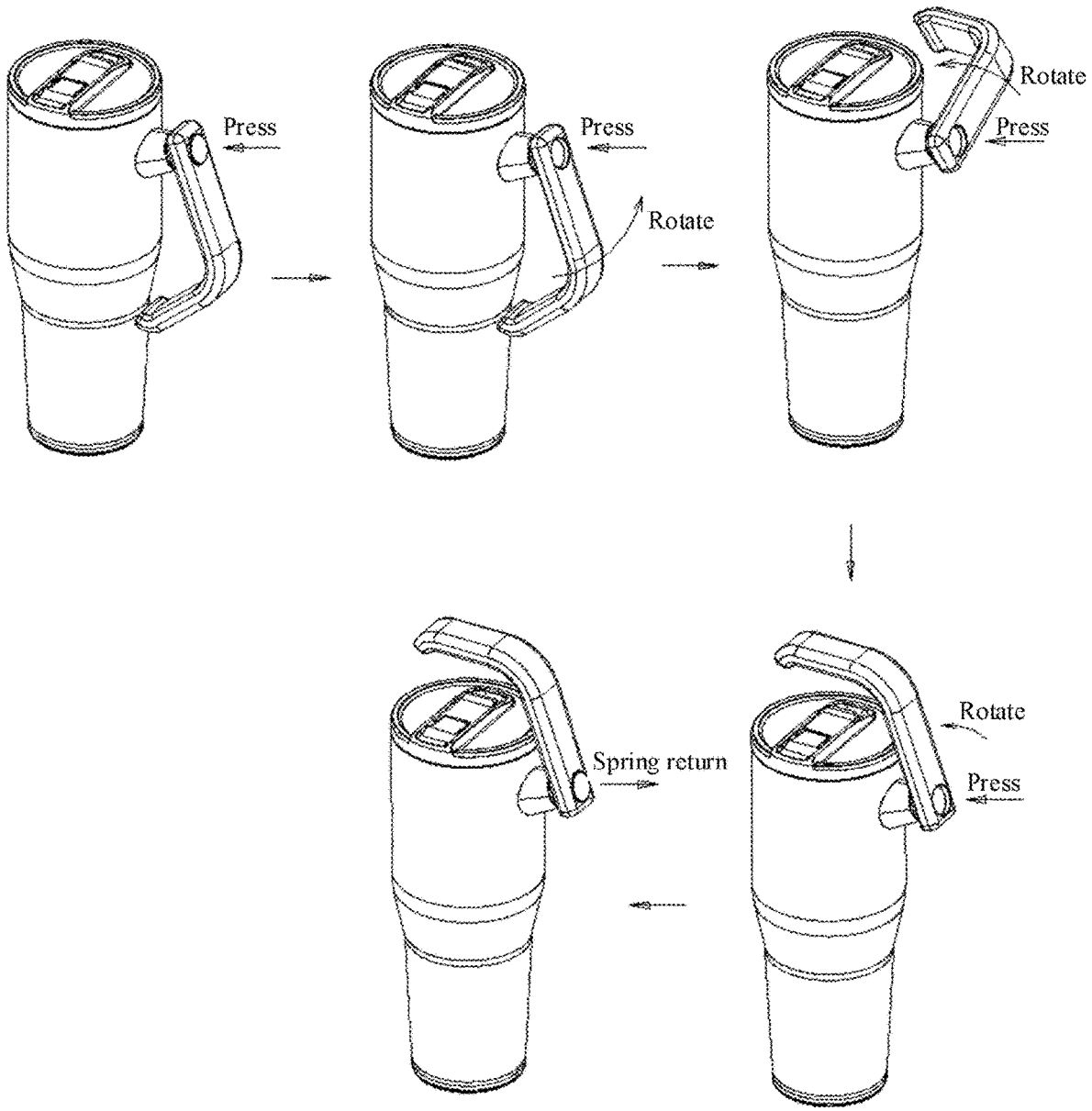
FIG. 19 is a schematic view illustrating operating steps for converting a bending handle in FIG. 11 into a lifting yoke.

An operation method in the second solution is as follows:

For an operating process for converting a grip (the bending handle 2 is located at the lowest position) into a lifting yoke, refer to FIG. 19. The button 6 is pressed. In a pressed state of the button, the bending handle 2 is rotated clockwise. When the lower end 2-2 of the bending handle is rotated around the fixed shaft 3 to the highest position, the button 6 is loosened. The button 6 is restored under the elastic force of the button spring 7. The locking device locks the handle shaft hole 2-1-1, such that the lower end 2-2 located directly above the cup body 1 forms the lifting yoke of the cup body 1.

Figure 20:
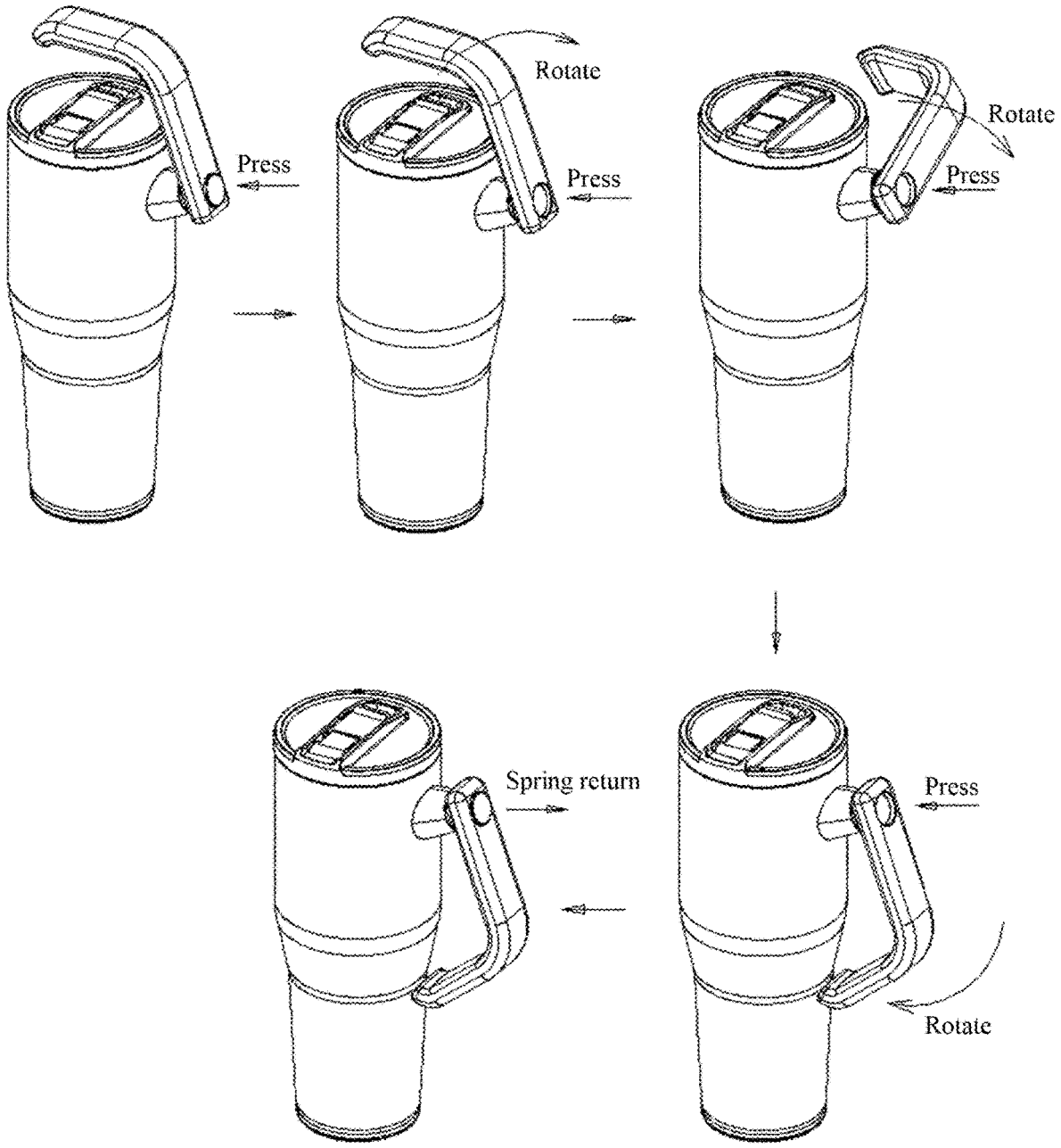
FIG. 20 is a schematic view illustrating operating steps for converting a bending handle in FIG. 11 into a grip.

For an operating process for converting the lifting yoke into the grip, refer to FIG. 20. The button 6 is pressed. In a pressed state of the button, the bending handle 2 is rotated clockwise. When the lower end 2-2 of the bending handle is rotated around the fixed shaft 3 to the lowest position, the button 6 is loosened. The button 6 is restored under the elastic force of the button spring 7. The locking device locks the handle shaft hole 2-1-1, such that the bending handle 2 located at a side of the cup body 1 forms the grip of the cup body 1.

What is claimed is:

1. A multifunctional cup handle, comprising a cup body, wherein an upper portion of an outer side of a wall of the cup body is provided with a cup protrusion; a fixed shaft is provided on the cup protrusion; an axis of the fixed shaft is formed into an included angle $\alpha$ of 40-80° with a vertical line; an upper end of a bending handle is provided with a handle shaft hole; the handle shaft hole is rotatably sleeved on the fixed shaft; and a locking device for stopping the handle shaft hole from rotating is provided on the fixed shaft;

when a lower end of the bending handle is rotated around the fixed shaft to a highest position, the locking device locks the handle shaft hole, such that the lower end of the bending handle located directly above the cup body forms a lifting yoke of the cup body;

when the lower end of the bending handle is rotated around the fixed shaft to a lowest position, the locking device locks the handle shaft hole, such that the bending handle located at a side of the cup body forms a grip of the cup body; and the locking device comprises: a mounting hole formed in a top or a bottom of the fixed shaft, a spring and a locking bead provided in the mounting hole, and stopping grooves respectively formed in a top and a bottom of the handle shaft hole and matching with the locking bead.

2. The multifunctional cup handle according to claim 1, wherein the fixed shaft comprises a narrow segment and a wide segment; the handle shaft hole is sleeved on the wide segment; a locating plane is at least provided on the narrow segment; a protrusion shaft hole matching with the narrow segment is formed in the cup protrusion; a straight-surface protrusion matching with the locating plane is provided in the protrusion shaft hole to stop the fixed shaft from rotating; and a fixing screw for fixing the narrow segment is provided on the cup protrusion.

* * * * *